US009415501B2

(12) United States Patent
Ho et al.

(10) Patent No.: US 9,415,501 B2
(45) Date of Patent: Aug. 16, 2016

(54) APPARATUS FOR MANUFACTURING A SEMICONDUCTOR DEVICE AND METHOD OF MANUFACTURING A SEMICONDUCTOR DEVICE

(71) Applicant: TAIWAN SEMICONDUCTOR MANUFACTURING COMPANY LTD., Hsinchu (TW)

(72) Inventors: Kuan-Lin Ho, Hsinchu (TW); Chin-Liang Chen, Kaohsiung (TW); Wei-Ting Lin, Taipei (TW); Yu-Chih Liu, Taipei (TW); Shih-Yen Lin, New Taipei (TW)

(73) Assignee: TAIWAN SEMICONDUCTOR MANUFACTURING COMPANY LTD., Hsinchu (TW)

( * ) Notice: Subject to any disclaimer, the term of this patent is extended or adjusted under 35 U.S.C. 154(b) by 217 days.

(21) Appl. No.: 14/013,971

(22) Filed: Aug. 29, 2013

(65) Prior Publication Data

US 2015/0059159 A1 Mar. 5, 2015

(51) Int. Cl.
*B25H 1/02* (2006.01)

(52) U.S. Cl.
CPC ..... *B25H 1/02* (2013.01); *Y10T 29/49998* (2015.01)

(58) Field of Classification Search
CPC . H05K 13/0069; H05K 2201/04; B23K 3/087
See application file for complete search history.

(56) References Cited

U.S. PATENT DOCUMENTS

| | | | | | |
|---|---|---|---|---|---|
| 4,688,658 | A * | 8/1987 | Stoner | B25H 1/04 | 182/153 |
| 5,067,695 | A * | 11/1991 | Huddleston | B23Q 1/032 | 269/21 |
| 5,226,823 | A * | 7/1993 | Johnson | H05K 7/023 | 439/66 |
| 5,626,067 | A * | 5/1997 | Lothe | B26B 29/06 | 269/289 R |
| 6,651,970 | B2 * | 11/2003 | Scott | A47J 47/005 | 269/13 |
| 7,036,809 | B1 * | 5/2006 | Mitchell | A47J 47/16 | 269/289 R |
| 8,172,622 | B1 * | 5/2012 | Huang | H01L 25/16 | 439/701 |
| 2003/0071406 | A1 * | 4/2003 | Sellers | A47J 47/005 | 269/289 R |
| 2011/0014802 | A1 * | 1/2011 | Demuynck | H01L 23/32 | 439/68 |
| 2011/0197502 | A1 * | 8/2011 | Morris | A01G 9/12 | 47/39 |

* cited by examiner

*Primary Examiner* — Lee D Wilson
(74) *Attorney, Agent, or Firm* — WPAT, P.C., Intellectual Property Attorneys; Anthony King

(57) ABSTRACT

An apparatus for manufacturing a semiconductor device includes a holder for holding a carrier and a supporting base for receiving the holder comprising a recess for accommodating a plurality of balls mounted on a surface of the carrier. Furthermore, a method of manufacturing a semiconductor device includes providing a carrier, providing an apparatus comprising a supporting base including a recess, holding the carrier on the supporting base and accommodating a plurality of balls mounted on a surface of the carrier in the recess.

19 Claims, 15 Drawing Sheets

APPARATUS FOR MANUFACTURING A SEMICONDUCTOR DEVICE AND METHOD OF MANUFACTURING A SEMICONDUCTOR DEVICE

FIELD

The disclosure relates to an apparatus for manufacturing a semiconductor device and a method of manufacturing a semiconductor device.

BACKGROUND

Electronic equipments involving semiconductor devices are indispensable from our daily life. With the advancement of electronic technology, electronic equipments become smaller and smaller in size, and thus semiconductor devices inside the electronic equipments are also getting smaller, thinner and lighter. Thus, flip chip packing (FCP) and wafer level packaging (WLP) technology have been gaining in popularity and is widely applied. This technology provides a wafer level manufacturing of the semiconductor devices with high functions and performances while the size of the semiconductor devices is minimized.

FCP and WLP technology are widely adopted for assembling and combining a number of semiconductor components to become a semiconductor package as a chip scale package (CSP) so as to minimize the final size of the semiconductor device as well as the electronic equipment. During the operations of assembling the semiconductor package, the semiconductor package is stored and transported from an operation to a subsequent operation by a supporter such as a tray, a boat, a rack or a magazine etc. However, the semiconductor package includes many semiconductor components with complicated structure and involves many complicated manufacturing operations. The semiconductor package is easily damaged during transportation and transition between operations.

As a complexity of the manufacturing operations and the configuration of the CSP are increased, there are more challenges to a yield of manufacturing and a simplification of operations. As such, there is a continuous need to improve the method for processing the CSP and solve the above deficiencies.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF THE INVENTION

Figure 1:
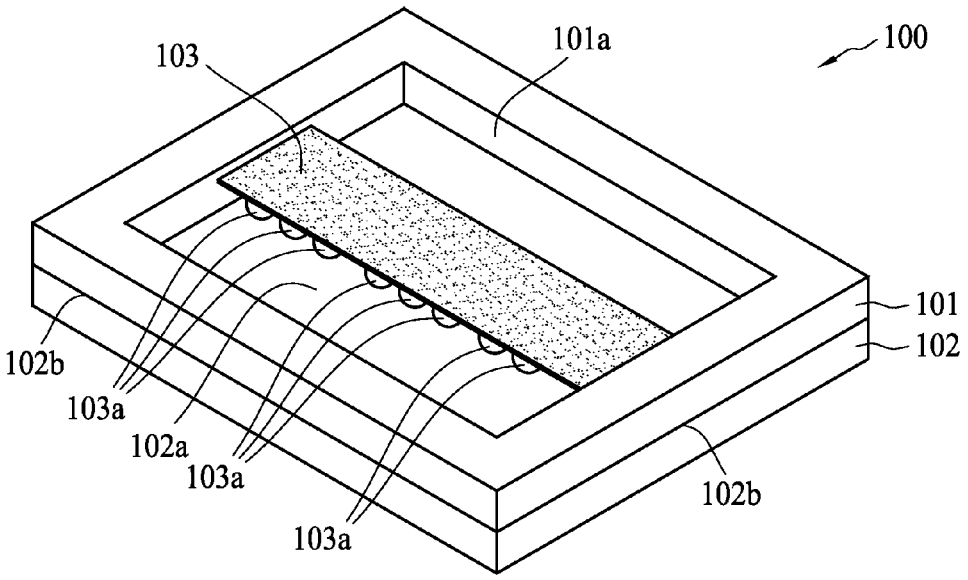
FIG. 1 is a schematic view of an apparatus including a holder and a supporting base in accordance with some embodiments of the present disclosure.

A semiconductor package is manufactured by a number of operations. During the manufacturing of the semiconductor package such as flip chip scale package (FCCSP), a flip chip die is bonded on a wafer substrate held by a boat. A number of solder bumps pads on the wafer substrate are bonded with a number of flip chip solder bumps on a bottom surface of the flip chip die. The flip chip solder bumps are then reflowed by a heat treatment. Underfill and molding compound including an electrically non-conductive material are applied to fill space between the flip chip die and the flip chip solder bumps in order to protect the flip chip solder bumps from cracking. The flip chip die is then individualized from the wafer substrate by singulation.

Each of the flip chip die is transferred from the tray to a boat for a subsequent operations of heat sink attachment and ball mounting, and the solder balls have to be heat treated by reflow. The FCCSP is then transferred from the boat back to the tray for packing and dispatching. However, such manufacturing operations involve many transitions of the wafer substrate between different supporters, for example tray to boat or boat to tray.

Furthermore, the heat sink has to be attached on the die and the underfill and molding compound have to be used for heat sink attachment even the die is damaged or without die before the operations of heat sink attachment. This leads to materials wastage issue.

The manufacturing and use of the embodiments are discussed in details as below. It should be appreciated, however, that the embodiments provide many applicable inventive concepts that can be embodied in a wide variety of specific contexts. It is to be understood that the following disclosure provides many different embodiments or examples for implementing different features of various embodiments. Specific examples of components and arrangements are described below to simplify the present disclosure. These are, of course, merely examples and are not intended to be limiting.

Embodiments, or examples, illustrated in the drawings are disclosed below using specific language. It will nevertheless be understood that the embodiments and examples are not intended to be limiting. Any alterations and modifications in the disclosed embodiments, and any further applications of the principles disclosed in this document are contemplated as would normally occur to one of ordinary skill in the pertinent art.

Further, it is understood that several processing steps and/or features of a device may be only briefly described. Also, additional processing steps and/or features can be added, and certain of the following processing steps and/or features can be removed or changed while still implementing the claims. Thus, the following description should be understood to represent examples only, and are not intended to suggest that one or more steps or features is required.

In addition, the present disclosure may repeat reference numerals and/or letters in the various examples. This repetition is for the purpose of simplicity and clarity and does not in itself dictate a relationship between the various embodiments and/or configurations discussed.

In the present disclosure, a semiconductor package manufactured by an apparatus and a method of manufacturing the semiconductor package for simplifying the manufacturing operations and reducing the manufacturing cost are disclosed. The apparatus is configured for holding the semiconductor package so as to facilitate certain manufacturing operations and thus improve an operation throughput. Furthermore, the method of manufacturing the semiconductor package has simplified the manufacturing operations, reduced a material and manufacturing cost, lower yield loss and less risk of damages of the semiconductor package.

FIG. 1 is an embodiment of an apparatus 100. The apparatus 100 for manufacturing a semiconductor package includes a holder 101 for holding a carrier 103 and a supporting base 102 for receiving the holder 101. The holder 101 is disposed on top of the supporting base 102. The holder 101 is supported on the supporting base 102 by a periphery 102*b* of the supporting base 102. The holder 101 covers and stacks on the supporting base 102. In some embodiments, the holder 101 includes a through hole 101*a* for receiving the carrier 103. In some embodiments, the holder 101 has a similar profile and dimension as the supporting base 102. For example, both the holder 101 and the supporting base 102 are configured in rectangular shape with similar size as in FIG. 1. In some embodiments, the holder 101 and the supporting base 102 respectively include a metal such as aluminum or etc.

Figure 2:
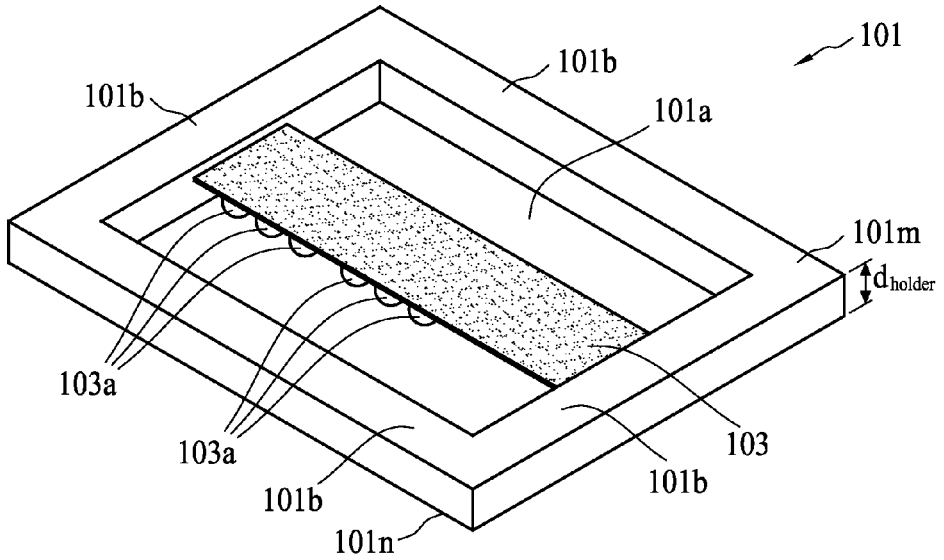
FIG. 2 is a schematic view of a holder including a through hole in accordance with some embodiments of the present disclosure.

In some embodiments, the holder 101 is in a frame shape as in FIG. 2. The holder 101 includes one or more strips 101*b* and a through hole 101*a*. The strips 101*b* and the through hole 101*a* are configured to be a closed loop for holding the carrier 103. The through hole 101*a* is surrounded by the strips 101*b*. The through hole 101*a* is defined by extending from a top surface 101*m* through a bottom surface 101*n* of the holder 101 along a depth $d_{holder}$ of the holder 101. The through hole 101*a* is configured to have a dimension so that a substantial area of the carrier 103 is housed within the through hole 101*a* as in FIG. 2.

Figure 2A:
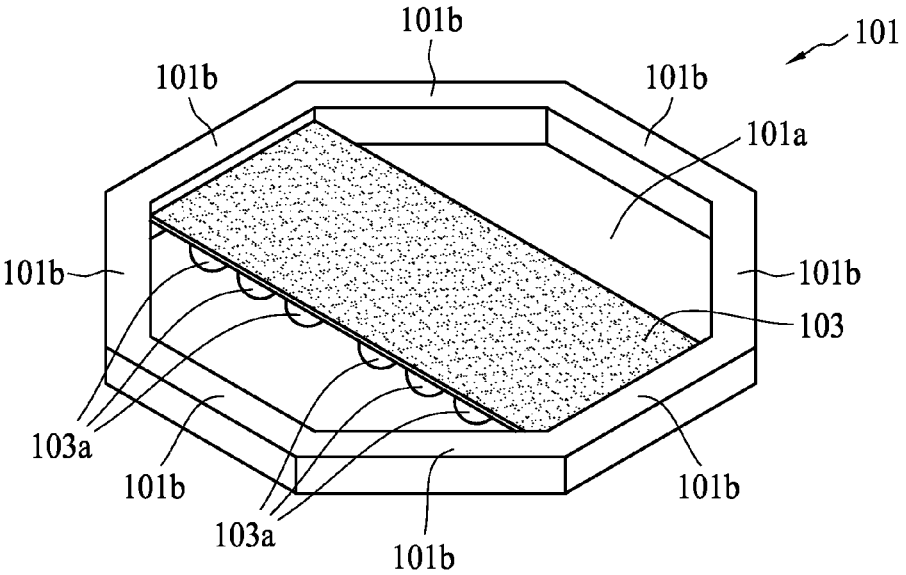
FIG. 2A is a schematic view of a holder in a polygonal shape in accordance with some embodiments of the present disclosure.
Figure 2B:
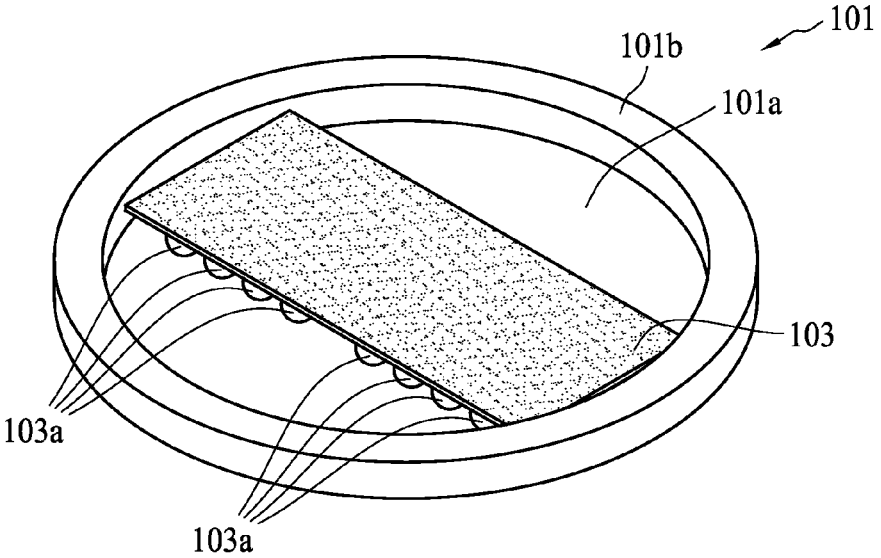
FIG. 2B is a schematic view of a holder in a circular shape in accordance with some embodiments of the present disclosure.

In some embodiments, the holder 101 includes four strips 101*b* in a rectangular frame shape as in FIG. 2, or includes numbers of strips 101*b* in a polygonal frame shape as in FIG. 2A, or includes a continuous strip 101*b* in a circular frame shape as in FIG. 2B, or etc. In some embodiments, the shape of the holder 101 is substantially the same as a shape of the through hole 101*a*. For example, the holder 101 and the through hole 101*a* are in a quadrilateral shape as in FIG. 2, or the holder 101 and the through hole 101*a* are in a polygonal shape as in FIG. 2A, or the holder 101 and the through hole 101*a* are in a circular shape as in FIG. 2B, etc. Other shapes of the strips 101*b* are within the contemplated scope of the present disclosure.

Figure 3:
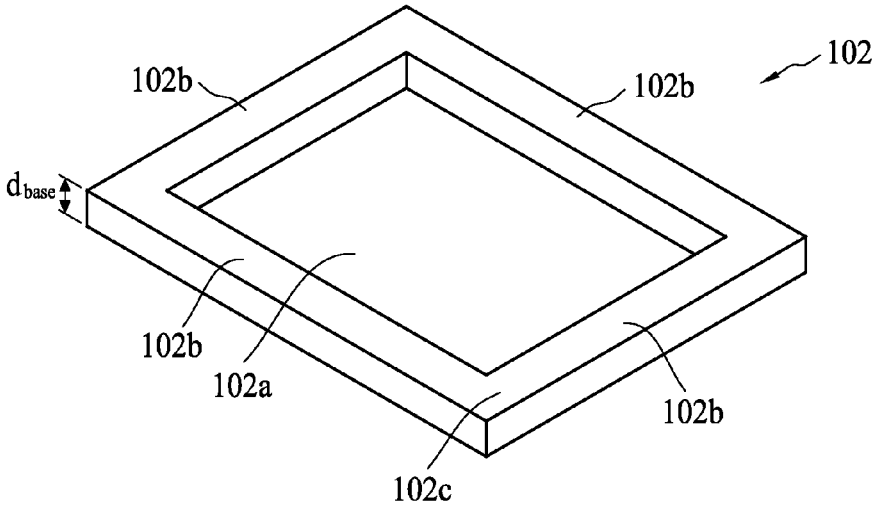
FIG. 3 is a schematic view of a supporting base including a recess in accordance with some embodiments of the present disclosure.
Figure 3A:
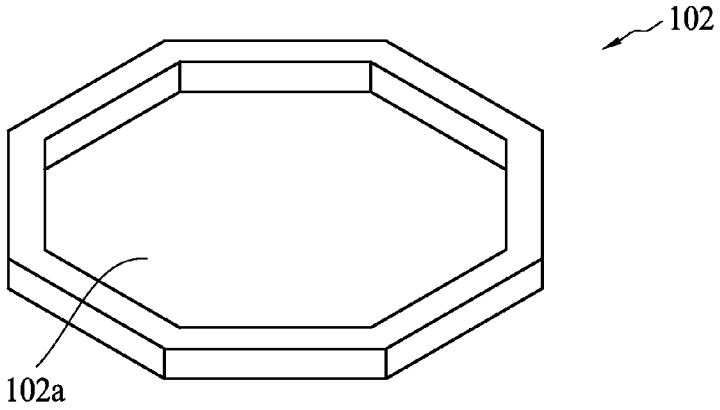
FIG. 3A is a schematic view of a supporting base in a polygonal shape in accordance with some embodiments of the present disclosure.
Figure 3B:
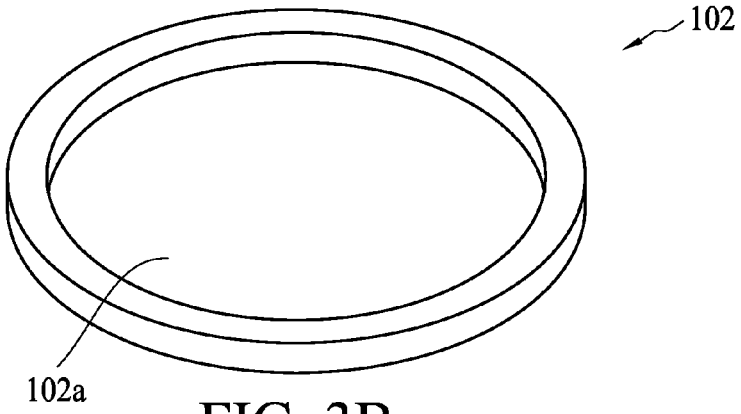
FIG. 3B is a schematic view of a supporting base in a circular shape in accordance with some embodiments of the present disclosure.
Figure 4:
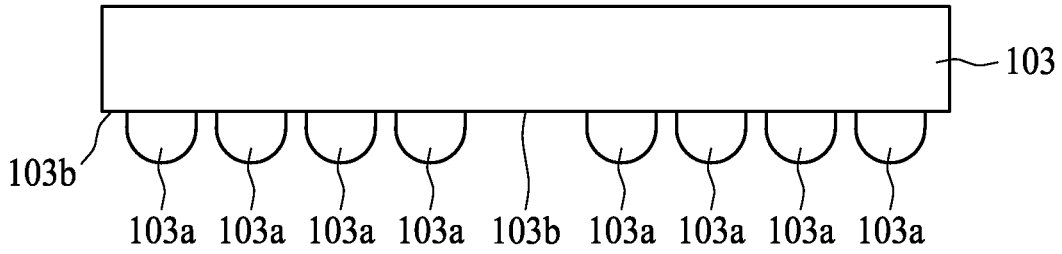
FIG. 4 is a schematic view of a carrier including a number of balls in accordance with some embodiments of the present disclosure.

In some embodiments, the supporting base 102 includes a recess 102*a* as in FIG. 3. The recess 102*a* is configured for accommodating a number of balls 103*a* mounted on a surface 103*b* of the carrier 103 as in FIG. 4. In some embodiment, the carrier 103 is in a strip shape. The recess 102*a* is a cavity surrounded by a periphery 102*b* of the supporting base 102. The recess 102*a* is extended from a top surface 102*c* of the supporting base 102 along a depth $d_{base}$ of the supporting base 102. In some embodiments, the supporting base 102 is in various shapes. The recess 102*a* and the periphery 102*b* of the supporting base 102 are in a quadrilateral shape as in FIG. 3, or in a polygonal shape as in FIG. 3A, or in a circular shape as in FIG. 3B, or etc.

In some embodiments, a holder is in similar profile and dimension as a supporting base. The shape and dimension of the holder and the supporting base are matched and cooperated with each other in order to stack the holder on the supporting base. In some embodiments, the quadrilateral holder 101 as in FIG. 2 stacks and covers on the quadrilateral supporting base 102 as in FIG. 3, or the polygonal holder 101 as in FIG. 2A stacks and covers on the polygonal supporting base 102 as in FIG. 3A, or the circular holder 101 as in FIG. 2B stacks and covers on the circular supporting base 102 as in FIG. 3B, or etc.

In some embodiments, a through hole of a holder is in similar profile and dimension as a recess of a supporting base. The recess is substantially overlapped with the through hole of the holder. The shape and dimension of the through hole and the recess are matched with each other, so that a carrier is housed within the through hole and balls on the carrier 103 are passed through the through hole and accommodated by the recess. In some embodiments, the quadrilateral through hole 101*a* as in FIG. 2 overlaps with the quadrilateral recess 102*a* as in FIG. 3, or the polygonal through hole 101*a* as in FIG. 2A overlaps with the polygonal recess 102*a* as in FIG. 3A, or the circular through hole 101*a* as in FIG. 2B overlaps with the circular recess 102*a* as in FIG. 3B, or etc.

Figure 5A:
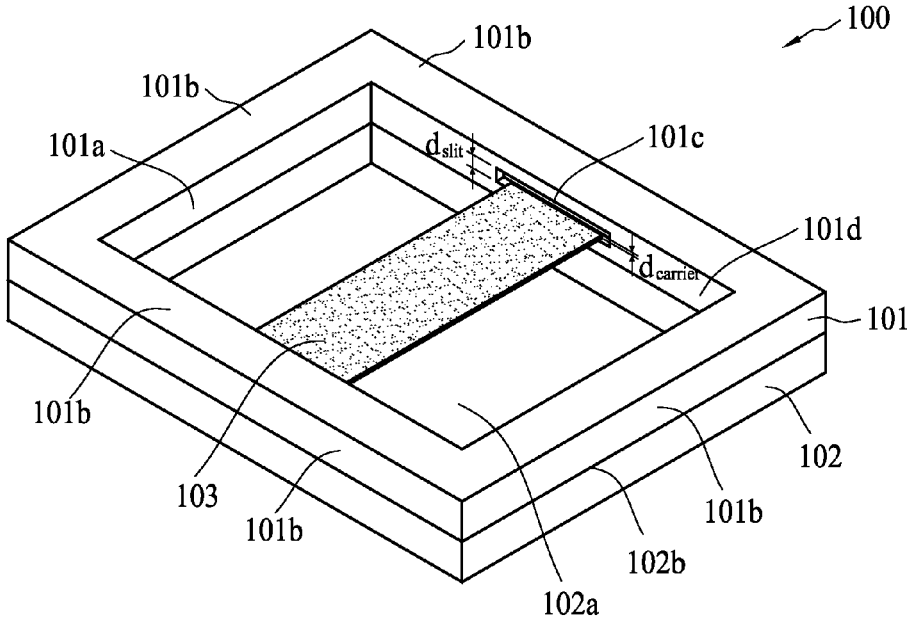
FIG. 5A is a schematic view of a holder including a slit in accordance with some embodiments of the present disclosure.

FIG. 5A is an embodiment of a holder 101 which holds a carrier 103 by a slit 101*c* on a strip 101*b*. The slit 101*c* is disposed on a surface of the strip 101*b*. In some embodiments, the surface is a sidewall 101*d* of a through hole 101*a*. The slit 101*c* is configured for receiving and housing a periphery 103*c* of the carrier 103. The periphery 103*c* of the carrier 103 inserts into the slit 101*c* to hold the carrier 103. In some embodiments, the carrier 103 is snapped into the slit 101*c* and thus securely held within the slit 101*c*. The slit 101*c* is configured in an elongated quadrilateral shape on the sidewall 101*d* of the through hole 101*a* as in FIG. 5A. In some embodiments, the slit 101*c* is shaped and sized in accordance with a thickness $d_{carrier}$ of the carrier 103. In some embodiments, a depth $d_{slit}$ of the slit 101*c* is substantially the same as the thickness $d_{carrier}$ of the carrier 103.

Figure 5B:
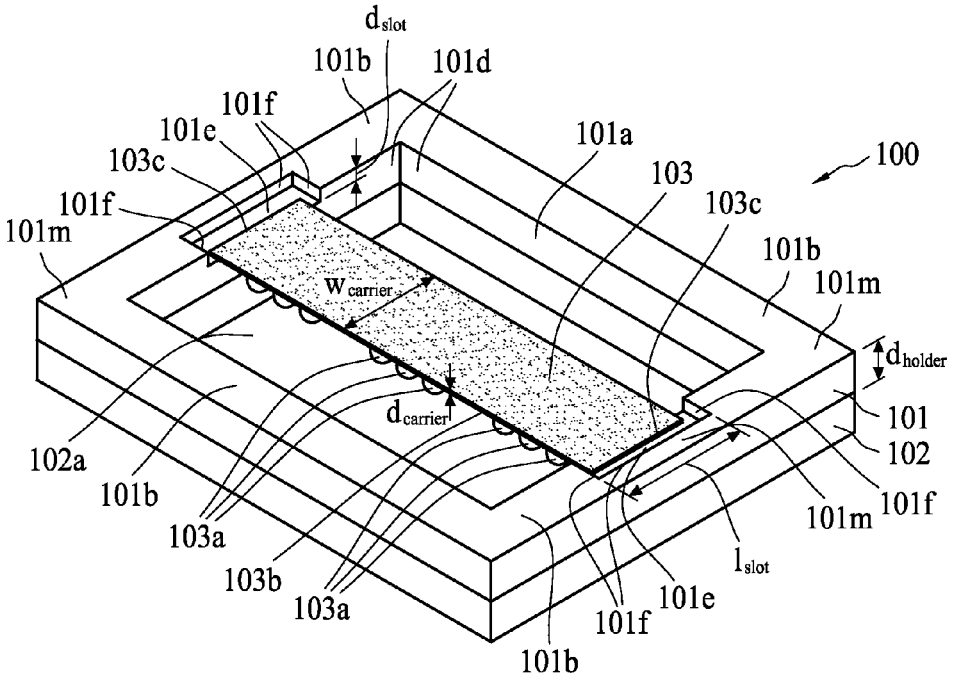
FIG. 5B is a schematic view of a holder including a slot in accordance with some embodiments of the present disclosure.

FIG. 5B is an embodiment of a holder 101 which holds a carrier 103 by a slot 101*e* on a strip 101*b*. The slot 101*e* is indented from a top surface 101*m* of the holder 101. The slot 101*e* is configured for receiving a periphery 103*c* of the carrier 103. The carrier 103 is disposed within and held by the slot 101*e*. The slot 101*e* is extended from the top surface 101*m* of the holder 101 along a depth $d_{holder}$ of the holder 101. In some embodiments, the slot 101*e* is configured in an elongated quadrilateral shape with three sidewalls 101*f*, so that the carrier 103 passes into the slot 101*e* from a side of the slot 101*e* and is held within the slot 101*e*. In some embodiments, the slot 101*e* is shaped and sized in accordance with a thickness $d_{carrier}$ of the carrier 103. In some embodiments, a depth $d_{slot}$ of the slot 101*e* is substantially the same as the thickness $d_{carrier}$ of the carrier 103, and a length $l_{slot}$ of the slot 101*e* is also substantially the same as a width $w_{carrier}$ of the carrier 103.

Figure 6A:
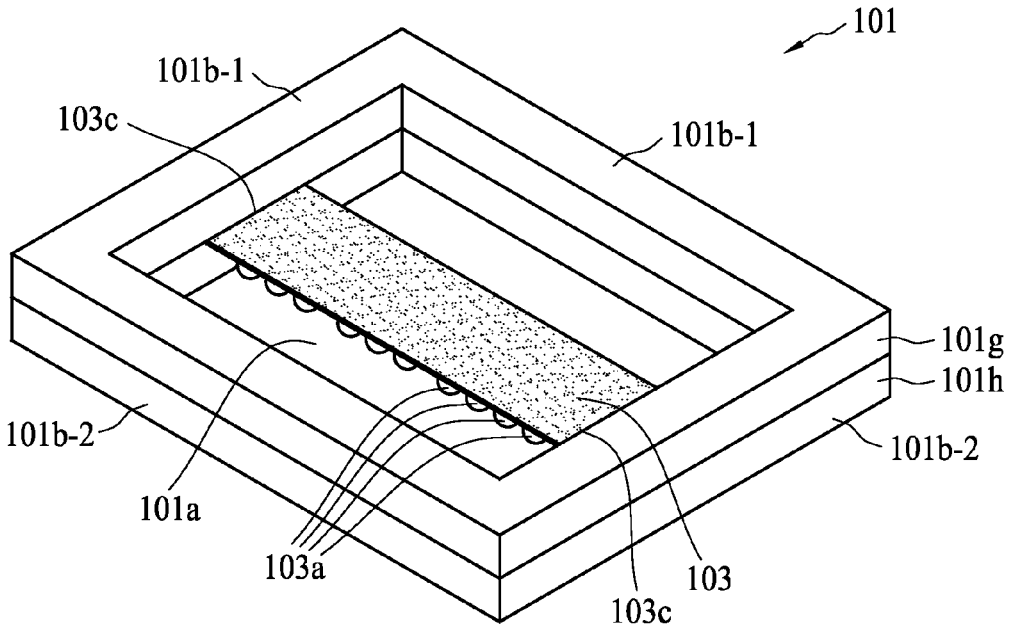
FIG. 6A is a schematic view of a holder including a first clipping member and a second clipping member in accordance with some embodiments of the present disclosure.

FIG. 6A is an embodiment of a holder 101 including a first clipping member 101*g* and a second clipping member 101*h* which are in cooperation for holding a carrier 103. The first clipping member 101*g* stacks on top of the second clipping member 101*h*, and the carrier 103 is clipped and securely held between the first clipping member 101*g* and the second clipping member 101*h*. As in FIG. 6B, the first clipping member 101*g* includes a through hole 101*a*-1 and one or more strips 101*b*-1, and the second clipping member 101*h* includes a through hole 101*a*-2 and one or more strips 101*b*-2. The first clipping member 101*g* and the second clipping member 101*h* are respectively configured in a closed loop by the strips 101*b*-1 and the strips 101*b*-2. In some embodiments, the first clipping member 101*g* is shaped and sized substantially the same as the second clipping member 101*h*.

Figure 6B:
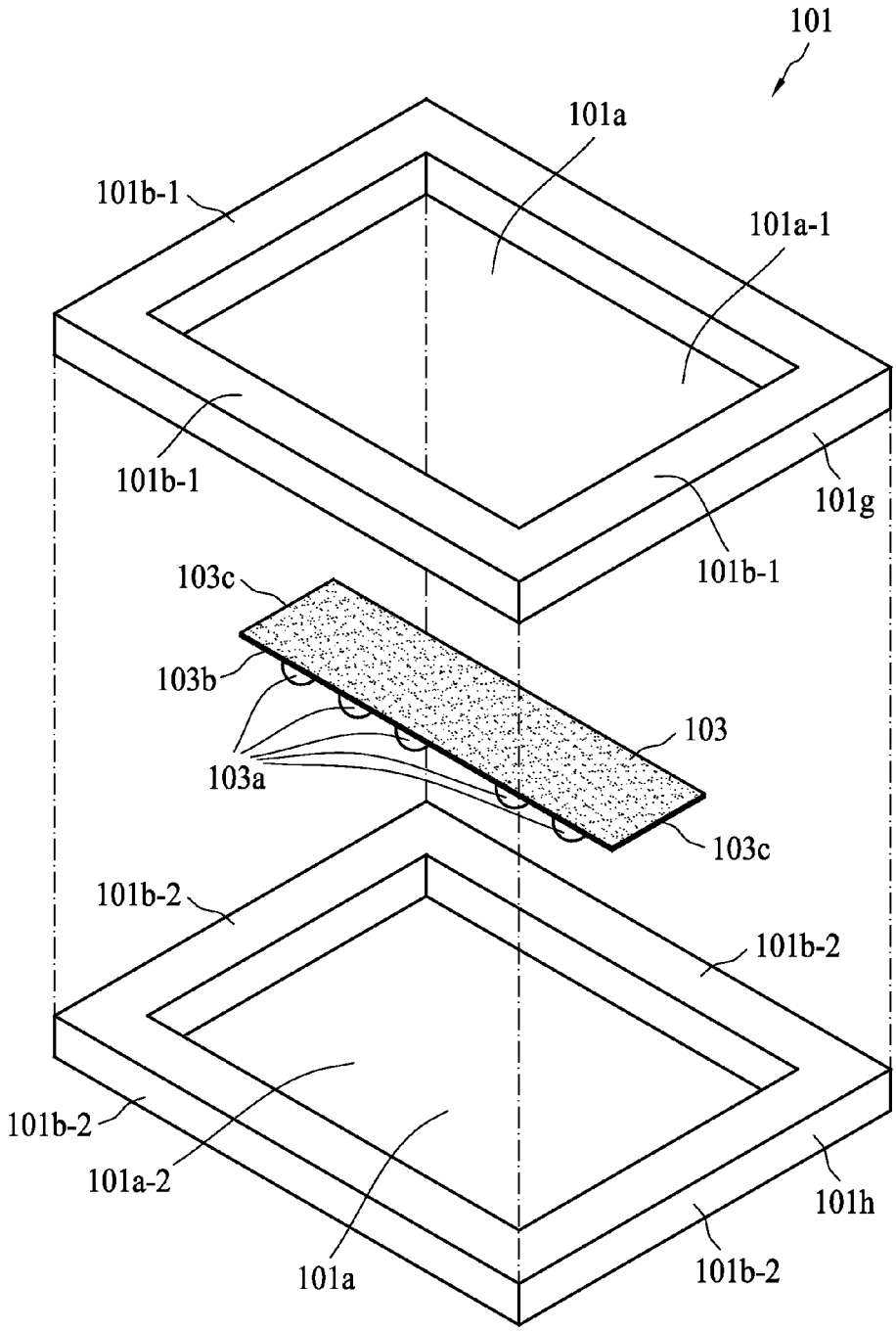
FIG. 6B is an exploded view of a holder including a first clipping member and a second clipping member and a carrier disposed between the first clipping member and the second clipping member in accordance with some embodiments of the present disclosure.

As in FIG. 6B, the carrier 103 is secured by disposing a periphery 103*c* of the carrier 103 between the first clipping member 101*g* and the second clipping member 101*h*. A periphery 103*c* of the carrier 103 is pressed by a cooperation of the first clipping member 101*g* and the second clipping member 101*h*. A number of balls 103*a* mounted on a surface 103*b* of the carrier 103 are received by a through hole 101*a* of the holder 101 and passed through from a through hole 101*a*-1 of the first clipping member 101*g* to a through hole 101*a*-2 of the second clipping member 101*h*.

Figure 6C:
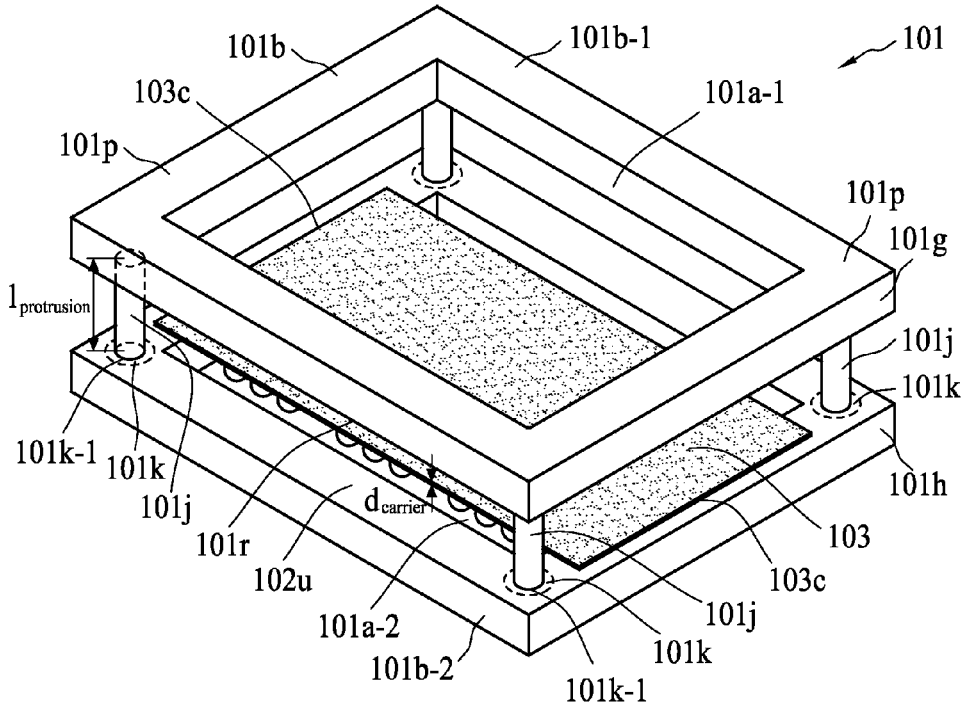
FIG. 6C is a schematic view of a holder including a first clipping member and a second clipping member coupled by a first interconnection structure in accordance with some embodiments of the present disclosure.

FIG. 6C is an embodiment of a holder 101 including a first interconnection structure (101*j*, 101*k*) for coupling a first clipping member 101*g* with a second clipping member 101*h* and thus clipping and securely holding a carrier 103. The first clipping member 101*g* is detachably coupled with the second clipping member 101*h* by the first interconnection structure (101*j*, 101*k*). The first interconnection structure (101*j*, 101*k*) is disposed on a strip 101*b* adjacent to a periphery 101*p* of the holder 101.

In some embodiments, the first clipping member 101*g* couples with the second clipping member 101*h* in various manner. The first clipping member 101*g* couples with the second clipping member 101*h* by magnetism, or the first clipping member 101*g* is pulled against the second clipping member 101*h* by vacuum.

In some embodiments, the first clipping member 101*g* couples with the second clipping member 101*h* by the first interconnection structure (101*j*, 101*k*) in various manner. In some embodiments, the first interconnection structure (101*j*, 101*k*) includes a number of protrusions 101*j* on a first clipping member 101*g* and a number of receptacles 101*k* on a second clipping member 101*h*. Each protrusion 101*j* corresponds to one of the receptacles 101*k*. In some embodiments, the protrusion 101*j* is extended from a bottom surface 101*r* of the first clipping member 101*g* towards the receptacle 101*k* of the second clipping member 101*h*.

The first clipping member 101*g* couples with the second clipping member 101*h* by the protrusion 101*j* and the receptacle 101*k* in various manner. In some embodiments, the protrusion 101*j* is snapped into the receptacle 101*k* to couple the first clipping member 101*g* with the second clipping member 101*h*. In some embodiments, the protrusion 101*j* is inserted into the receptacle 101*k* to press a periphery 103*c* of the carrier 103 and thus to secure the carrier 103 between the first clipping member 101*g* and the second clipping member 101*h*.

In some embodiments, the protrusion 101*j* is in cylindrical shape as in FIG. 6C. In some embodiments, the receptacle 101*k* is a cavity in circular shape as in FIG. 6C. In some embodiments, an interface of 101*k*-1 between the protrusion 101*j* and the receptacle 101*k* has substantially the same shape and size as the receptacle 101*k*, so that the protrusion 101*j* is fittingly accommodated by the receptacle 101*k*.

In some embodiments as in FIG. 6C, a length $l_{protrusion}$ of the protrusion 101*j* is substantially equal to the thickness $d_{carrier}$ of the carrier 103. The length $l_{protrusion}$ is a distance between the bottom surface 101*r* of the first clipping member 101*g* and a top surface 102*u* of the second clipping member 101*h* when the holder 101 is in a closed configuration that the first clipping member 101*g* is coupled with the second clipping member 101*h*. In some embodiments, the length $l_{protrusion}$ of the protrusion 101*j* is slightly greater than the thickness $d_{carrier}$ of the carrier 103.

Figure 6D:
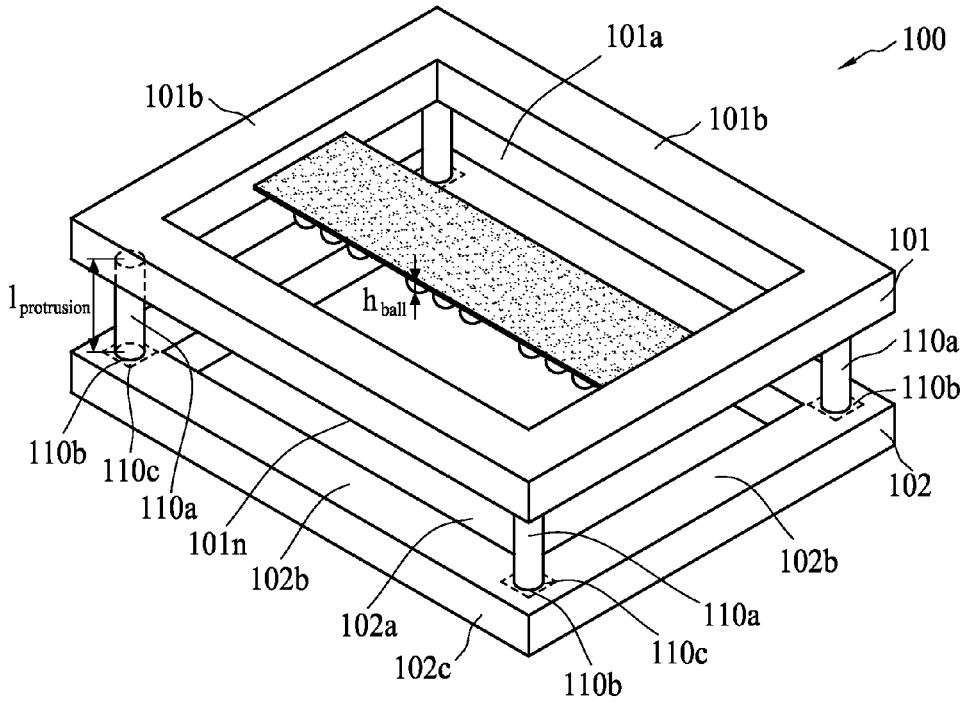
FIG. 6D is a schematic view of an apparatus including a holder coupled with a supporting base by a second interconnection structure in accordance with some embodiments of the present disclosure.

FIG. 6D is an embodiment of an apparatus 100 including a second interconnection structure (110*a*, 110*b*) for coupling a holder 101 with a supporting base 102 and thus securing the holder 101 on the supporting base 102. The holder 101 is detachably coupled with the supporting base 102 by the second interconnection structure (110*a*, 110*b*). The second interconnection structure (110*a*, 110*b*) is disposed on a strip 101*b* of the holder 101 and a periphery 102*b* of the supporting base 102.

The holder 101 couples with the supporting base 102 in various manner. In some embodiments, the second interconnection structure (110*a*, 110*b*) includes a number of projections 110*a* on a bottom surface 101*n* of the holder 101 and a number of indentations 110*b* on a periphery 102*b* of the supporting base 102. Each projections 110*a* corresponds to one of the indentations 110*b*. In some embodiments, the projection 110*a* is extended from the bottom surface 101*n* of the holder 101 towards the indentation 110*b* of the supporting base 102.

In some embodiments, the projection 110*a* is in cylindrical shape as in FIG. 6D. In some embodiments, the indentation 110*b* is a cavity in circular shape as in FIG. 6D. In some embodiments, an interface of 110*c* between the projection 110*a* and the indentation 110*b* has substantially the same shape and size as the indentation 110*b*, so that the projection 110*a* is fittingly accommodated by the indentation 110*b*.

In some embodiments, the holder 101 is coupled and held on the supporting base 102 by magnetism along the strips 101*b* of the holder and the periphery 102*b* of the supporting base, or the holder 101 is pulled against the periphery 102*b* of the supporting base 102 by vacuum.

In some embodiments as in FIG. 6D, a length $l_{projection}$ of the projection 110*a* is substantially equal to a ball height $h_{ball}$ of the balls 103*a* on the carrier 103. The length $l_{projection}$ is a distance between the bottom surface 101*n* of the holder 101 and a top surface 102*c* of the supporting base 102 when the apparatus 100 is in a closed configuration that the holder 101 is coupled with the supporting base 102. In some embodiments, the length $l_{projection}$ of the projection 110*a* is slightly greater than the ball height $h_{ball}$ of the balls 103*a* on the carrier 103.

Figure 7A:
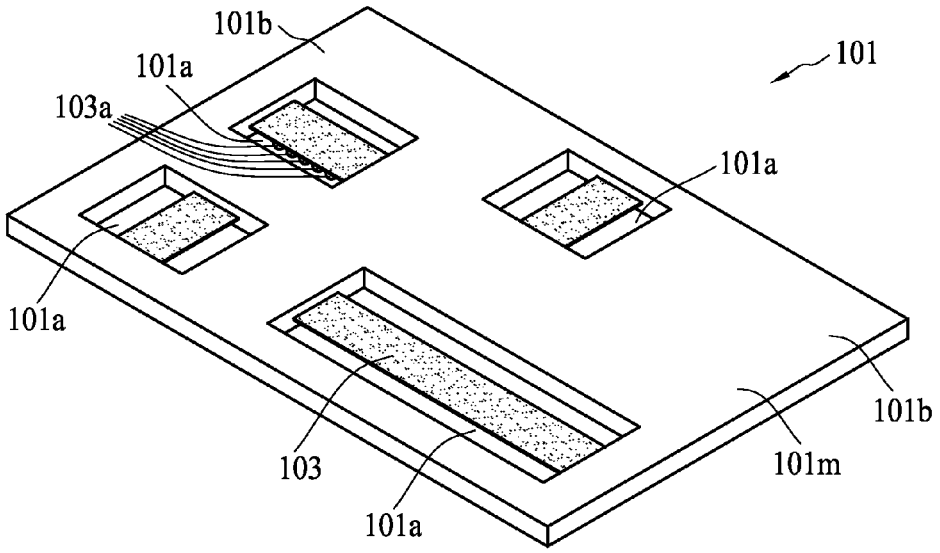
FIG. 7A is a schematic view of a holder in a mesh configuration in accordance with some embodiments of the present disclosure.

FIG. 7A is an embodiment of a holder 101 in a mesh configuration. The holder 101 includes a number of through holes 101*a*. Each through hole 101*a* is surrounded by one or more strips 101*b* and is configured for receiving and holding a carrier 103. The through hole 101*a* extends from a top surface 101*m* of the holder 101. A number of balls 103*a* on the carrier 103 pass through the through hole 101*a*.

Figure 7B:
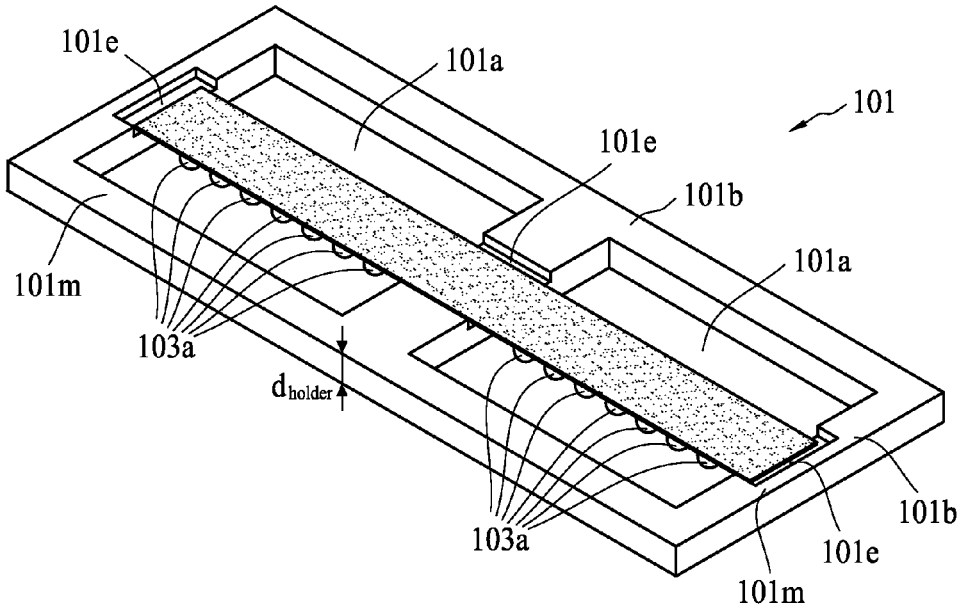
FIG. 7B is a schematic view of a holder in a mesh configuration with a number of slots in accordance with some embodiments of the present disclosure.

In some embodiments, the holder 101 in a mesh configuration includes a number of through holes 101*a* and a number of slots 101*e* as in FIG. 7B. The slot 101*e* is configured for holding a carrier 103. The slot 101*e* is indented from a top surface 101*m* of the holder 101 along a depth $d_{holder}$ of the holder 101. In some embodiments, the through holes 101*a* are surrounded by the strips 101*b* and are aligned with each other along a direction. The through holes 101*a* are aligned longitudinally as in FIG. 7B. In some embodiments, the carrier 103 is in a continuous strip form and is across over the slots 101*e* and is held within the slots 101*e*, so a number of balls 103*a* on the carrier 103 pass through the through holes 101*a* as in FIG. 7*b*.

Figure 8:
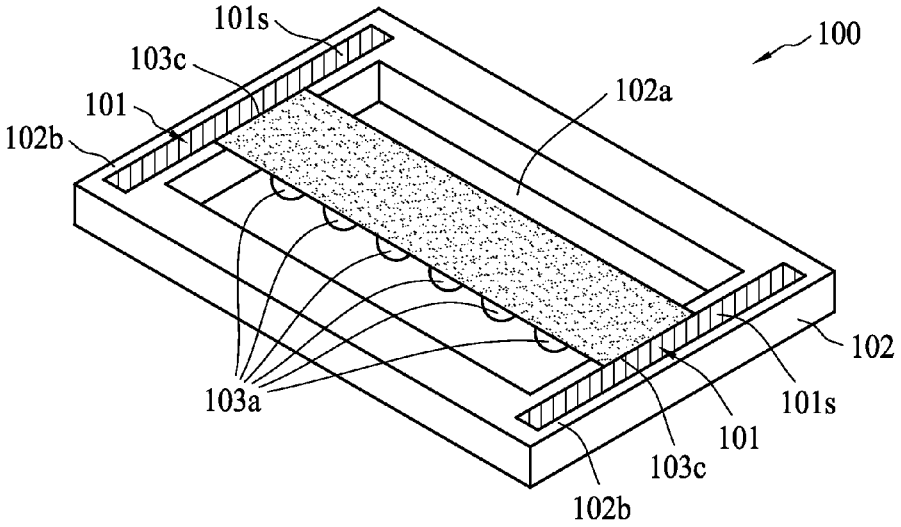
FIG. 8 is a schematic view of an apparatus including a supporting base and an elongated piece of a holder in accordance with some embodiments of the present disclosure.

FIG. 8 is an embodiment of an apparatus 100 for manufacturing a semiconductor package. The apparatus 100 includes a holder 101 for holding a carrier 103 and a supporting base 102 for accommodating a number of balls 103*a* on a surface 103*b* of the carrier 103. In some embodiments, the holder 101 includes a number of elongated pieces 101*s* for pressing and holding a periphery 103*c* of the carrier 103. The elongated piece 101*s* is disposed and supported on a periphery 102*b* of the supporting base 102. The periphery 103*c* of the carrier 103 is pressed on the supporting base 102 by the elongated pieces 101*s*, so that the carrier 103 is held between the holder 101 and the supporting base 102. In some embodiments, the holder 101 includes a pair of elongated pieces 101*s* which are in cooperation to hold the carrier 103 horizontally on the periphery 102*b* of the supporting base 102. In some embodiments, the pair of the elongated pieces 101*s* are configured such that the carrier 103 does not have any warpage, without curving into or out of the recess 102*a*.

In some embodiments, the supporting base 102 includes a recess 102*a* which is configured for accommodating the number of balls 103*a* on a carrier 103 as in FIG. 8. The recess 102*a* is surrounded by a periphery 102*b* of the supporting base 102. When the periphery 103*c* of the carrier 103 is disposed and pressed on the periphery 102*b* of the supporting base 102 by the holder 101, the balls 103*a* are seated within the recess 102*a*.

Figure 9:
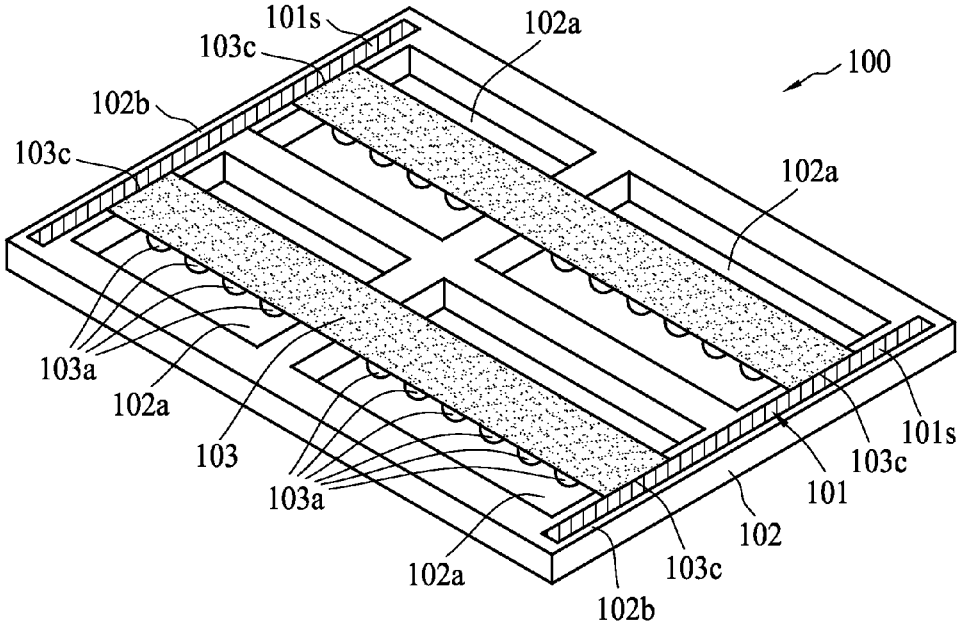
FIG. 9 is a schematic view of a supporting base in a mesh configuration with a number of recesses in accordance with some embodiments of the present disclosure.

FIG. 9 is an embodiment of an apparatus 100 including a supporting base 102 in a mesh configuration. The supporting base 102 includes a number of recesses 102*a* which are aligned with each other in a direction. In some embodiments, the recesses 102*a* are aligned vertically and horizontally as in FIG. 9. Each of the recesses 102*a* accommodates a number of balls 103*a* on a carrier 103. In some embodiments, the supporting base 102 receives and supports one or more carriers 103 in a strip shape. The carriers 103 is held by a pair of elongated pieces 101*s* of a holder 101 disposed on a periphery 102*b* of the supporting base 102. In some embodiments, the balls 103*a* are specifically arranged in accordance with a shape and size of the recess 102*a*, so that the balls 103*a* are accommodated by the recess 102*a*.

Figure 10:
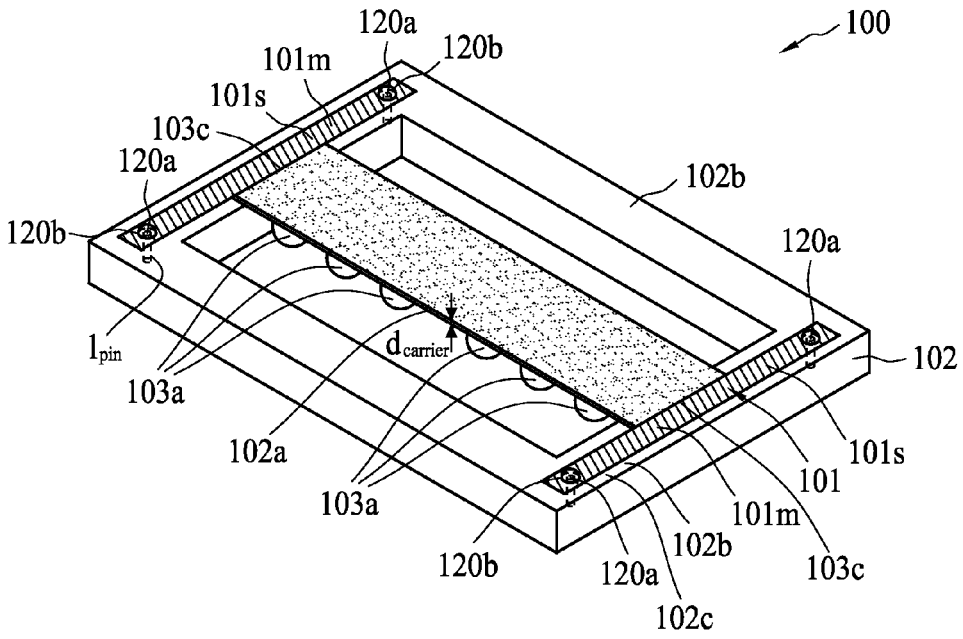
FIG. 10 is a schematic view of an apparatus including a third interconnection structure for coupling an elongated piece of a holder with a supporting base in accordance with some embodiments of the present disclosure.

FIG. 10 is an embodiment of an apparatus 100 including a third interconnection structure (120*a*, 120*b*) for coupling a number of elongated pieces 101*s* of a holder 101 with a supporting base 102 and thus securely holding the carrier 103 between the elongated piece 101*s* and the supporting base 102. The elongated piece 101*s* is detachably coupled with the supporting base 102 by the third interconnection structure (120*a*, 120*b*). In some embodiments, the third interconnection structure (120*a*, 120*b*) including a pin 120*a* and an aperture 120*b*. The pin 120*a* passes through the aperture 120*b* extending from a top surface 101*m* of the elongated piece 101*s* of the holder 101 to a top surface 102*c* of the supporting base 102, so that the elongated piece 101*s* is pressed on a periphery 103*c* of the carrier 103 and a periphery 102*b* of the supporting base 102.

In some embodiments, a length $l_{pin}$ of the pin 120*a* is substantially equal to the thickness $d_{carrier}$ of the carrier 103. The length $l_{pin}$ is a distance between a top surface 101*m* of the elongated piece 101*s* and a top surface 102*c* of the supporting base 102. In some embodiments, the length $l_{pin}$ of the pin 120*a* is slightly greater than the thickness $d_{carrier}$ of the carrier 103.

In the present disclosure, a method of manufacturing a semiconductor device is also disclosed. In some embodiments, a semiconductor device is formed by a method 200. The method 200 includes a number of operations and the description and illustration are not deemed as a limitation as the sequence of the operations.

Figure 11:
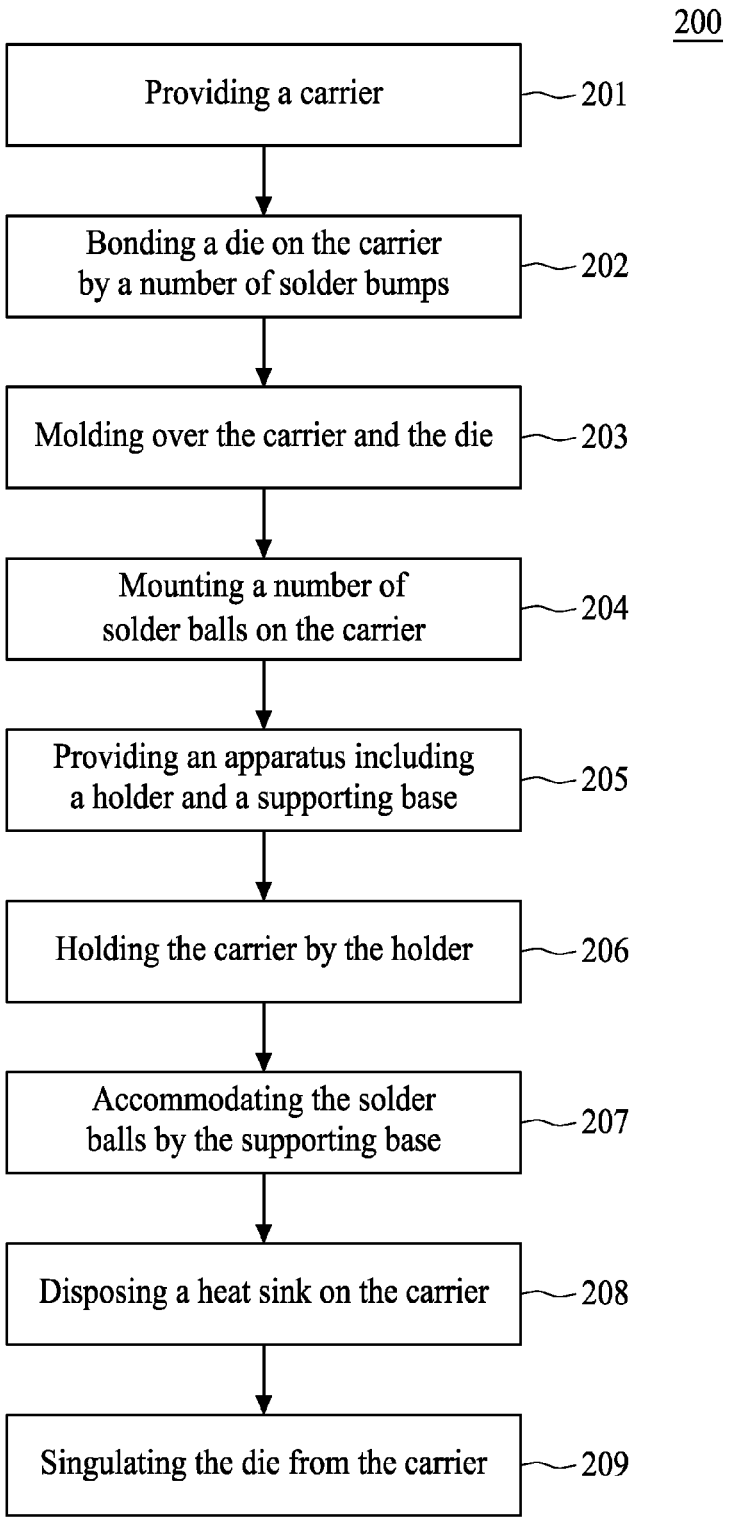
FIG. 11 is a flow diagram of a method of manufacturing a semiconductor device in accordance with some embodiments of the present disclosure.
Figure 11A:
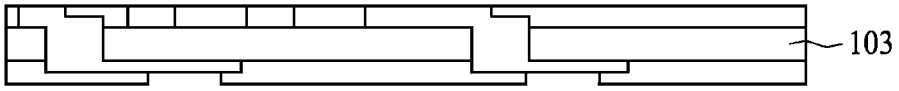
FIG. 11A is a schematic view of provision of a carrier in accordance with some embodiments of the present disclosure.

FIG. 11 is an embodiment of a method 200 of manufacturing a semiconductor device. The method 200 includes operations 201, 202, 203, 204, 205, 206, 207, 208, 209. In operation 201, a carrier 103 is provided as in FIG. 11A. In some embodiments, the carrier 103 is a substrate or interposer which includes a number of layers for carrying components and integrated circuits (IC) within the layers. The substrate or interposer is produced from crystal form of silicon or polymer through numbers of operations such as fabrication, etching or photolithography, etc.

Figure 11B:
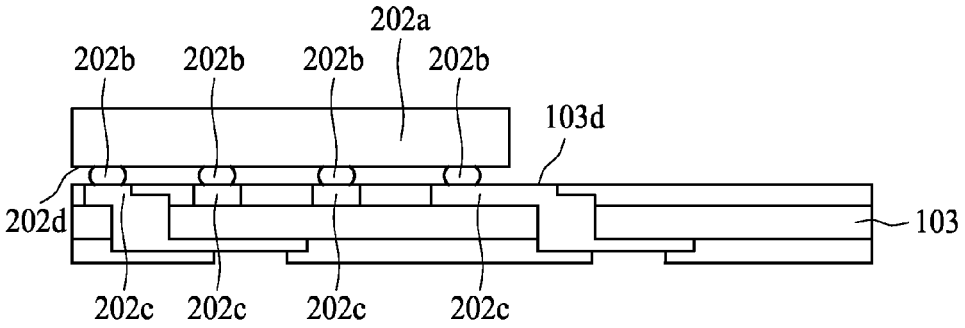
FIG. 11B is a schematic view of bonding a die on a carrier in accordance with some embodiments of the present disclosure.

In operation 202, a die 202*a* is bonded on the carrier 103 as in FIG. 11B. In some embodiments, the die 202*a* is a flip chip die 202*a* including a bottom surface 202*d* mounted on the carrier 103. In some embodiments, the flip chip die 202*a* is bonded on the carrier 103 by a number of solder bumps 202*b*. In some embodiments, the flip chip die 202*a* is bonded on the carrier 103 by a number of flip chip solder bumps. In some embodiments, there are a number of pads 202*c* formed on a top surface 103*d* of the carrier 103. The pads 202*c* are configured for receiving flip chip solder bumps 202*b*, so that the flip chip die 202*a* is mounted on the carrier 103 as in FIG. 11B.

Figure 11C:
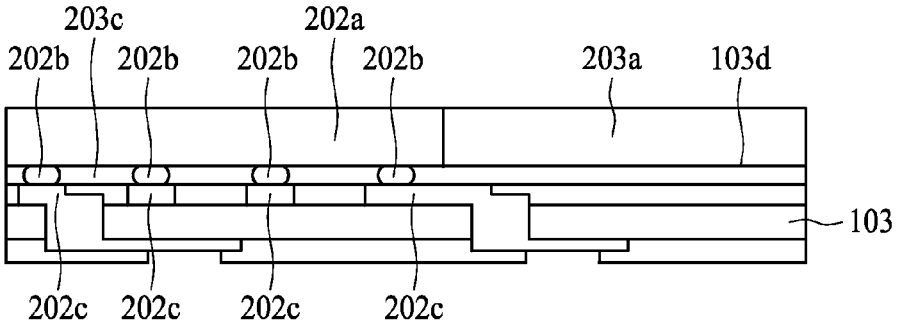
FIG. 11C is a schematic view of molding a die and a carrier in accordance with some embodiments of the present disclosure.

In operation 203, the carrier 103 and the flip chip solder bumps 202*b* are covered by a molding 203*a* as in FIG. 11C. The molding 203*a* covers a substantial top surface 103*d* of the carrier 103 and fills up a space 203*c* between flip chip die 202*a*, flip chip solder bumps 202*b* and carrier 103 in order to protect electrical interconnections between carrier 103 and flip chip solder bumps 202*b*.

In some embodiments, the molding 203*a* includes a molding compound including composite materials consisted of epoxy resin, silica, or etc. In some embodiments, the space 203*c* between the flip chip die 202*a* and the flip chip solder bumps 202*b* are filled by an underfill which includes an electrically non-conductive material.

Figure 11D:
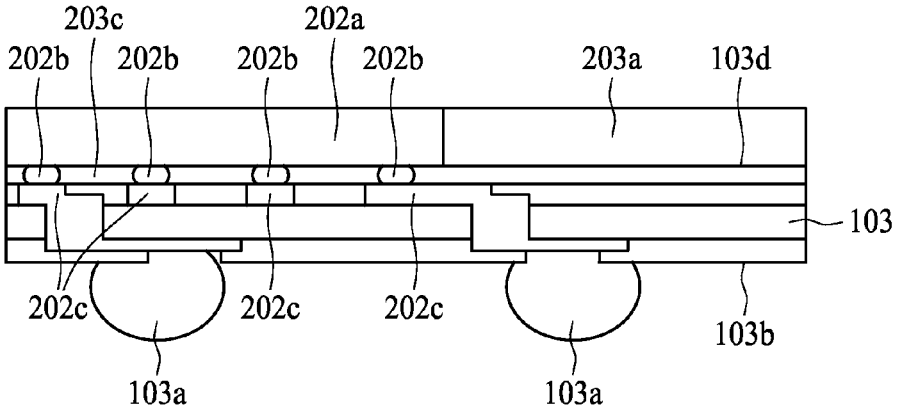
FIG. 11D is a schematic view of mounting a number of solder balls on a carrier in accordance with some embodiments of the present disclosure.

In operation 204, a number of solder balls 103*a* are mounted on a bottom surface 103*b* of the carrier 103 as in FIG. 11D. The solder balls 103*a* are respectively attached on a number of ball pads 204*a* on the bottom surface 103*b* of the carrier 103. In some embodiments, the ball pad 204*a* is a solderable surface which is exposed part of a circuit of the carrier 103. In some embodiments, the ball pad 204*a* is served as a platform for receiving the solder ball 103*a* and connecting the circuit of the carrier 103 with a circuit of the flip chip die 202*a*. The solder ball 103*a* is attached and bonded on the ball pad 204*a* after a heat treatment such as reflow or etc.

Figure 11E:
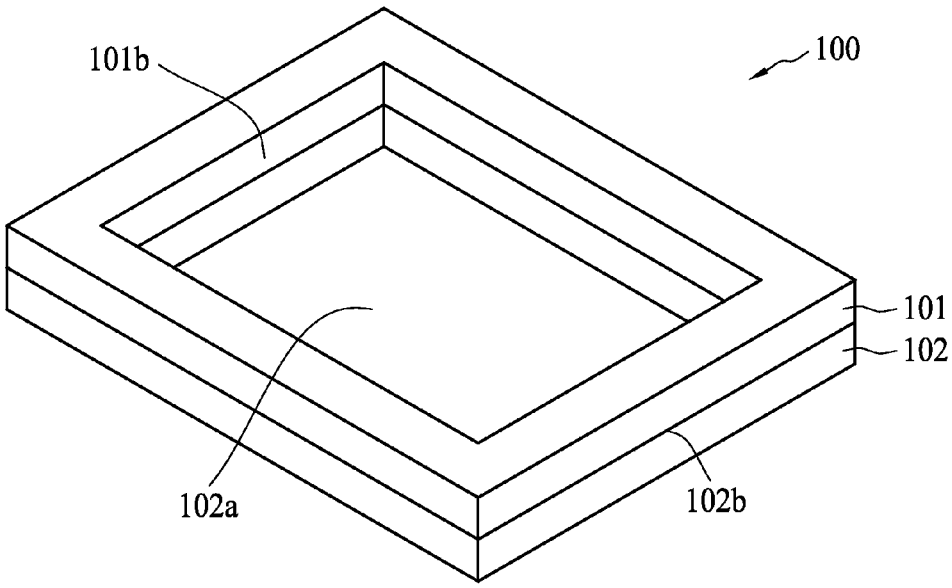
FIG. 11E is a schematic view of provision of an apparatus in accordance with some embodiments of the present disclosure.

In operation 205, an apparatus 100 is provided for holding the carrier 103 as in FIG. 11E. The apparatus 100 is formed including a holder 101 for holding the carrier 103 and a supporting base 102 for receiving the holder 101. The holder 101 is covered on top of the supporting base 102. In some embodiments, the holder 101 is supported on the supporting base 102 by a periphery 102*b* of the supporting base 102. In some embodiments, the holder 101 is formed in a similar profile and dimension as the supporting base 102, so that the holder 101 stacks on the supporting base 102. In some embodiments, the apparatus 100 is made of a metal or metal alloy with a high melting point, for example silicon carbide or etc.

Figure 11F:
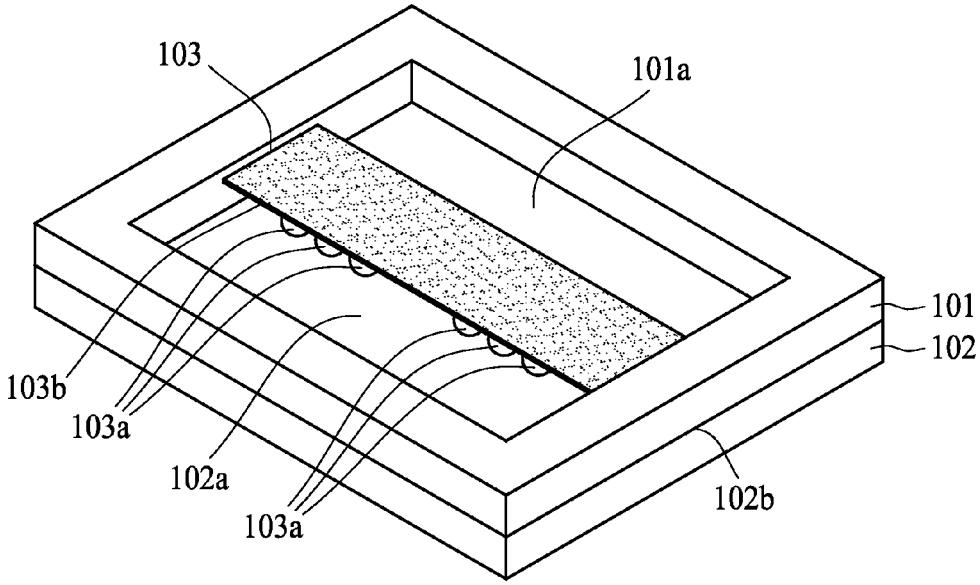
FIG. 11F is a schematic view of holding a carrier by an apparatus in accordance with some embodiments of the present disclosure.

In operation 206, the carrier 103 is held by the holder 101 of the apparatus 100 as in FIG. 11F. The carrier 103 is held within a through hole 101*a* of the holder 101 and a recess 102*a* of the supporting base 102. In some embodiments, the through hole 101*a* is formed in a central part of the holder 101 for receiving and holding the carrier 103. In some embodiments, a substantial area of the carrier 103 is held within the through hole 101*a* as in FIG. 11F. In some embodiments, the carrier 103 is securely held by the holder 101 in various manner such as clipping between two clipping members, pressing by a number of elongated pieces, accommodating within slots or slits, pressing by magnetism or vacuum, or etc.

Figure 11G:
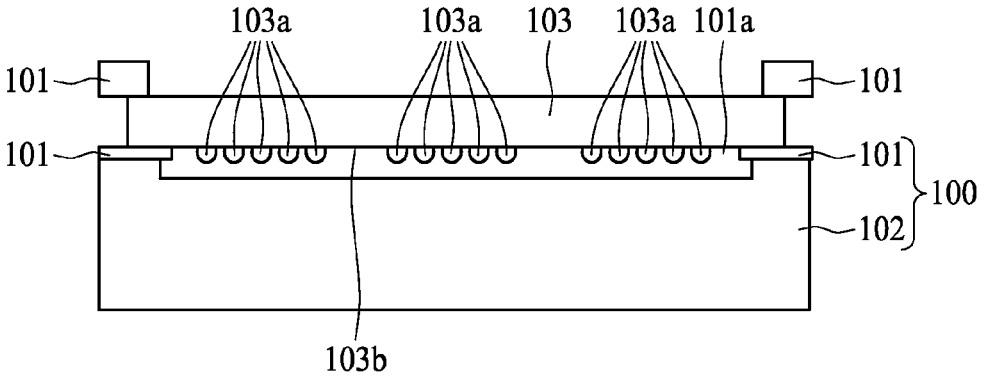
FIG. 11G is a schematic view of accommodating a number of solder balls by a supporting base in accordance with some embodiments of the present disclosure.
Figure 11H:
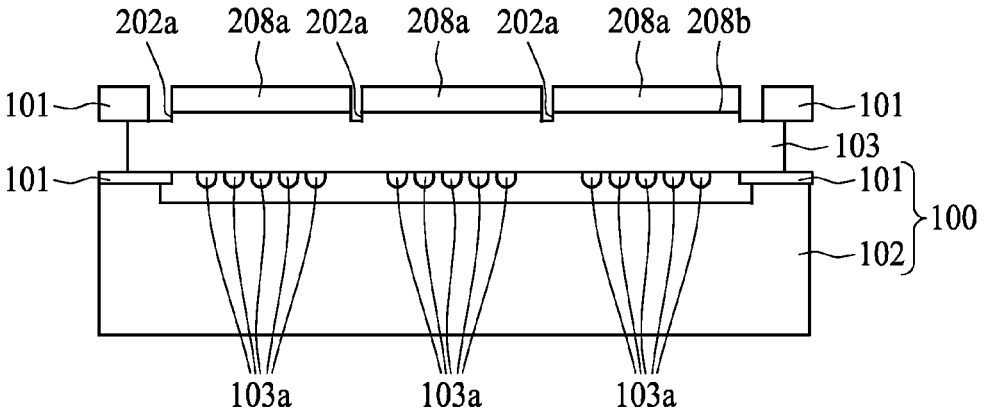
FIG. 11H is a schematic view of disposing a heat sink over a carrier in accordance with some embodiments of the present disclosure.

In operation 207, the solder balls 103*a* on the carrier 103 are accommodated by the supporting base 102 as in FIG. 11G. The solder balls 103*a* pass through the through hole 101*a* of the holder 101 and seat within the recess 102*a* of the supporting base 102. In some embodiments, the recess 102*a* is formed adjacent to a central part of the supporting base 102 to receive and accommodate the solder balls 103*a* mounted on the bottom surface 103*b* of the carrier 103. The solder balls 103*a* are hanged within the recess 102*a* as in FIG. 11G in order to prevent the solder balls 103*a* from collision and damages. In some embodiments, the recess 102*a* of the supporting base 102 is substantially overlapped with the through hole 101*a* of the holder 101.

In operation 208, a heat sink 208*a* is disposed on top of the flip chip die 202*a* when the carrier 103 is held by the apparatus 100 including the holder 101 and the supporting base 102. In some embodiment, the heat sink 208*a* is attached and covered on a top surface 208*b* of the flip chip die 202*a* on the carrier 103. The heat sink 208*a* is configured for dissipating a heat from the die 202*a* to the surrounding. In some embodiments, the heat sink 208*a* is made of a metal such as aluminum or a metal alloy or etc.

In operation 209, the flip chip die 202*a* is singulated from the carrier 103. The flip chip die 202*a* is saw out from the carrier 103 by a mechanical saw to become a semiconductor package such as flip chip scale package (FCCSP), which would be dispatched out or transported for subsequent operations.

In some embodiments, an apparatus for manufacturing a semiconductor package, including a holder for holding a carrier and a supporting base for receiving the holder including a recess for accommodating a plurality of balls mounted on a surface of the carrier. The holder is disposed and supported on the supporting base by a periphery of the supporting base. The holder includes a first clipping member and a second clipping member which are in cooperation for holding the carrier.

In some embodiments, the holder includes a first interconnection structure for coupling the first clipping member with the second clipping member. The first interconnection structure includes a protrusion on the first clipping member and a receptacle on the second clipping member for receiving the protrusion. The apparatus further includes a second interconnection structure for coupling the holder and the supporting base. The second interconnection structure includes a projection on the holder and an indentation on the supporting base for receiving the projection.

In some embodiments, the holder is in a mesh configuration. The supporting base is in a mesh configuration. The supporting base includes aluminum. The carrier is in a strip shape.

In some embodiments, an apparatus for manufacturing a semiconductor package, including a supporting base includes a periphery and a recess. The periphery is configured for securely holding a carrier on the supporting base, and the recess is configured for accommodating a plurality of balls mounted on a surface of the carrier. The recess is substantially surrounded by the periphery. The periphery is configured for securing the carrier on the supporting base by magnetism. The periphery is configured for securing the carrier on the supporting base by vacuum.

In some embodiments, a method of manufacturing a semiconductor package, including providing a carrier, providing an apparatus including a supporting base including a recess, holding the carrier on the supporting base and accommodating a plurality of balls mounted on a surface of the carrier in the recess. The method further includes disposing a heat sink over the carrier upon holding the carrier by the apparatus. The method further includes holding the carrier on a periphery of the supporting base by magnetism. The method further includes providing the apparatus including a holder and securely holding a carrier within the holder by a first interconnection structure. The method further includes securely disposing the holder on the supporting base by a second interconnection structure.

The methods and features of this invention have been sufficiently described in the above examples and descriptions. It should be understood that any modifications or changes without departing from the spirit of the invention are intended to be covered in the protection scope of the invention.

Moreover, the scope of the present application in not intended to be limited to the particular embodiments of the process, machine, manufacture, and composition of matter, means, methods and steps described in the specification. As those skilled in the art will readily appreciate from the disclosure of the present disclosure, processes, machines, manufacture, composition of matter, means, methods or steps presently existing or later to be developed, that perform substantially the same function or achieve substantially the same result as the corresponding embodiments described herein maybe utilized according to the present disclosure.

Accordingly, the appended claims are intended to include within their scope such as processes, machines, manufacture, compositions of matter, means, methods or steps. In addition, each claim constitutes a separate embodiment, and the combination of various claims and embodiments are within the scope of the invention.

What is claimed is:

1. An apparatus for manufacturing a semiconductor device, the semiconductor device including a plurality of bumps mounted on a surface of the semiconductor device, the apparatus comprising:

a holder for holding the semiconductor device, the holder comprising a plurality of strips connected to one another and configured as a close loop periphery, and a through hole surrounded by the strips, wherein the through hole is extended from a top surface of the holder to a bottom surface of the holder, wherein the holder further comprises a plurality of slots; and a supporting base for receiving the holder, wherein the supporting base comprises a recess for receiving the plurality of bumps mounted on the surface of the semiconductor device.

2. The apparatus of claim 1, wherein the holder comprises a first clipping member and a second clipping member which are in cooperation for holding the semiconductor device.

3. The apparatus of claim 2, wherein the holder comprises a first interconnection structure for coupling the first clipping member with the second clipping member.

4. The apparatus of claim 3, wherein the first interconnection structure comprises a protrusion on the first clipping member and a receptacle on the second clipping member for receiving the protrusion.

5. The apparatus of claim 1, further comprising a second interconnection structure for coupling the holder and the supporting base.

6. The apparatus of claim 5, wherein the second interconnection structure comprises a projection on the holder and an indentation on the supporting base for receiving the projection.

7. The apparatus of claim 1, wherein the holder is in a mesh configuration.

8. The apparatus of claim 1, wherein the supporting base is in a mesh configuration.

9. The apparatus of claim 1, wherein the supporting base includes aluminum.

10. The apparatus of claim 1, wherein the semiconductor device is in a strip shape.

11. An apparatus for manufacturing a semiconductor device, the semiconductor device including a plurality of balls mounted on a surface of the semiconductor device, the apparatus comprising:

a holder for holding the semiconductor device, wherein the holder comprises a plurality of slots; and a supporting base comprises a periphery and a plurality of recesses, wherein each of the recesses is configured as a close loop recess;

wherein the periphery is configured for securely holding the semiconductor device on the supporting base, and the recesses are configured for receiving the plurality of bumps mounted on the surface of the semiconductor device.

12. The apparatus of claim 11, wherein the recesses are substantially surrounded and separated by the periphery.

13. The apparatus of claim 11, wherein the periphery is configured for securing the semiconductor device on the supporting base by magnetism.

14. The apparatus of claim 11, wherein the periphery is configured for securing the semiconductor device on the supporting base by vacuum.

15. The apparatus of claim 1, wherein the holder and the supporting base have a similar dimension and shape.

16. An apparatus for manufacturing a semiconductor device, the semiconductor device including a plurality of balls mounted on a surface of the semiconductor device, the apparatus comprising:

a holder including a frame and a through hole defined by the frame, wherein the through hole is extended from a top surface to a bottom surface of the holder along a depth of the holder;

wherein the holder further comprises a plurality of slots;

wherein the frame is configured to hold and receive a periphery of the semiconductor device, and a substantial area of the semiconductor device is housed within the through hole.

17. The apparatus of claim 16, wherein the frame comprises a plurality of strips.

18. The apparatus of claim 16, wherein the holder is configured to be disposed on a supporting base.

19. The apparatus of claim 16, wherein the holder is in rectangular, circular, quadrilateral or polygonal shape.

* * * * *